United States Patent [19]

Naimer

[11] 4,408,392

[45] Oct. 11, 1983

[54] ELECTRIC SHAVER

[75] Inventor: Gundolf Naimer, Graz, Austria

[73] Assignee: Payer-Lux Elektroprodukte Gesellschaft m.b.H., Graz, Austria

[21] Appl. No.: 249,970

[22] Filed: Apr. 1, 1981

[30] Foreign Application Priority Data

Apr. 3, 1980 [AT] Austria ..... 1839/80

[51] Int. Cl.[3] ..... B26B 19/10

[52] U.S. Cl. ..... 30/34.1; 74/110

[58] Field of Search ..... 30/34.1; 74/110

[56] References Cited

U.S. PATENT DOCUMENTS 3,413,718 12/1968 Baumann ..... 30/34.1

3,552,007 1/1971 Yamada ..... 30/34.1

3,909,938 10/1975 Brenneman ..... 30/34.1

*Primary Examiner*—Jimmy C. Peters

*Attorney, Agent, or Firm*—Frost & Jacobs

[57] ABSTRACT

An electric shaver having a casing, a shear head and a long-hair cutter, the long-hair cutter being extensible as far as possible when in use and completely retracted into the casing when not in use, the long-hair cutter being slidably supported within the casing and movable from a retracted to an extended position by means of a manually actuable pusher which is also slidably supported within the casing, the pusher being connected to the long-hair cutter by a motion-multiplying coupling which causes the long-hair cutter to move at least twice the distance which the pusher travels when actuated.

7 Claims, 12 Drawing Figures

ELECTRIC SHAVER

BACKGROUND OF THE INVENTION

The invention relates to an electric shaver having a casing, a shear head and a long-hair cutter.

In known shavers of this type, the long-hair cutter—even when not in use—always more or less protrudes from the shear head, which impedes the normal shaving operation and might cause scratching of the facial skin by the comparatively coarse teeth (serrations) of the long-hair cutter. On the other hand, when using the long-hair cutter, the shaver's vision of the spot to be cut is impaired by the shear head for normal shaving and some spots are nearly inaccessible for the long-hair cutter.

In order to overcome these difficulties, a known shaver is provided with a long-hair cutter slidable forward in a straight line by means of a button when needed. In this shaver, however, the sliding distance of the long-hair cutter achievable by the movement of the thumb while grasping the shaver does not suffice for solving the problems mentioned above. Moreover, the long-hair cutter is still visible and an obstacle when not in use.

SUMMARY OF THE INVENTION

It is the object of the invention to achieve an effective solution of the problems outlined above. This object is achieved in an electric shaver of the type initially described by arranging the long-hair cutting unit within the casing and movable in relation to it and providing a manually actuable pusher supported in a sliding guide within the casing and coupled with the long-hair cutting unit for the movement of the long-hair cutting unit, the coupling between pusher and long-hair cutting unit being effected by means of a coupling in such a manner that the long-hair cutting unit moves at least twice the distance which the pusher travels when actuated.

It is of particular advantage to provide the coupling in the form of a push-pull strip permanently fixed to the casing by one end, then turned by 180° and connected by its other end to the long-hair cutting unit which is movable in relation to the casing, a semicircular guide in which the push-pull strip is slidably supported being provided within the pusher for turning the strip.

The coupling can also consist of two tension strips or tension cables of which each is permanently fixed to the casing by one end, then turned by 180° and connected to the long-hair cutting unit which is movable in relation to the casing by the other end, two opposedly directed, semicircular guides supporting one each tension strip being provided within the pusher for turning the two tension strips.

The coupling can also consist of one tension strip or tension cable permanently fixed to the casing by both of its ends and turned by 180° adjacent to each end, the connecting point of the tension strip to the long-hair cutting unit which is movable in relation to the casing being arranged between these two turns two opposedly directed, semicircular guides being provided for turning the tension strip within the pusher.

The coupling could also have the form of a gear wheel—gear rack transmission, a lever transmission or an eccentric transmission.

A particularly practical development of the shaver according to the invention is characterized in that the movement of the long-hair cutting unit in relation to the casing is composed of a rectilinear sliding motion and a pivoting motion. For this purpose, the long-hair cutting unit consists of a tilting member pivotably supported on the pusher, on the one hand, and a knife support with mobile knife and clipping comb slidably supported on and pivotable with said tilting member, on the other hand, the coupling being connected to the knife support and to the casing. In order to effect pivoting movement of the tilting member and thus the entire long-hair cutting unit, the case is provided with an inclined guide engagable by the long-hair cutting unit as it is moved relative to the case and the long-hair cutting unit is held in its pivoted position by the inclined guide.

It may be advantageous to provide the casing with an inclined surface adjacent the cutting end of the clipping comb in the retracted state of the long-hair cutting unit, said surface serving as an inclined guide.

It is further practical to hold the long-hair cutting unit in its pivoted position by the terminal edge of the inclined surface acting on the clipping comb.

According to a further development of the shaver according to the invention, it is particularly advantageous to arrange the entire long-hair cutting unit including the pusher within a depression provided in the casing, so that the long-hair cutting unit is completely flush with the casing in its retracted state.

The following advantages can be achieved by means of the shaver according to the invention:

The long-hair cutting unit can be extended substantially farther and even tilted away from the shear head without increasing the path of travel of the pusher.

The user's vision of the spot to be cut is improved, as it is not covered by the shear head.

The construction facilitates access of the long-hair cutter to spots otherwise difficult to reach.

Since the long-hair cutter in the shaver according to the invention can be telescopically extended and retracted, it can be made completely flush with the shaver or the casing thereof; there are no interfering, protruding and visible knife parts of the long-hair cutter in its retracted state.

The shaver according to the invention is described in the following by means of an embodiment under reference to the drawings.

DESCRIPTION OF THE PREFERRED EMBODIMENTS

Figure 1:
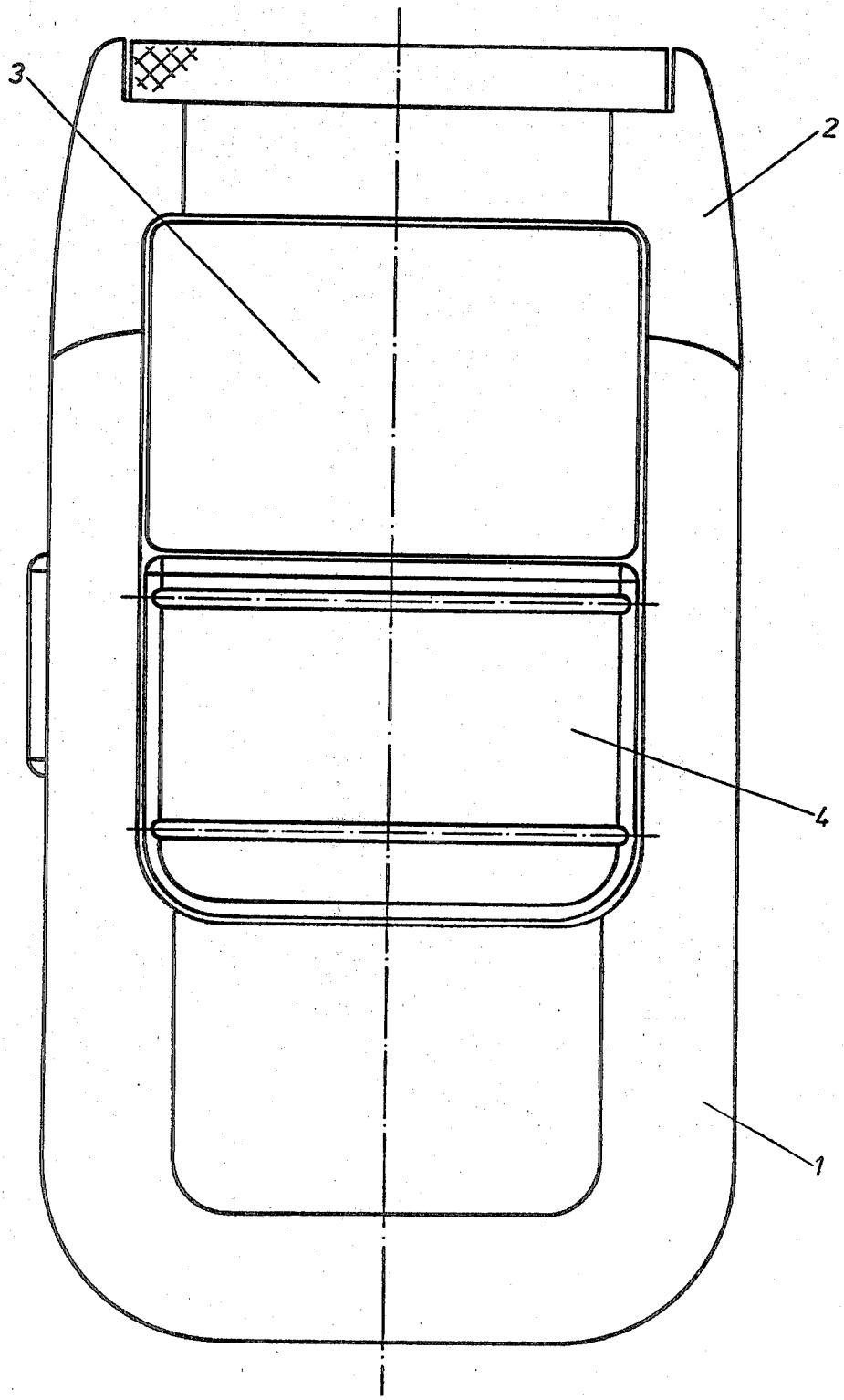
FIG. 1 is a plan view of the broad side of the shaver in which the long-hair cutting unit is arranged.
Figure 2:
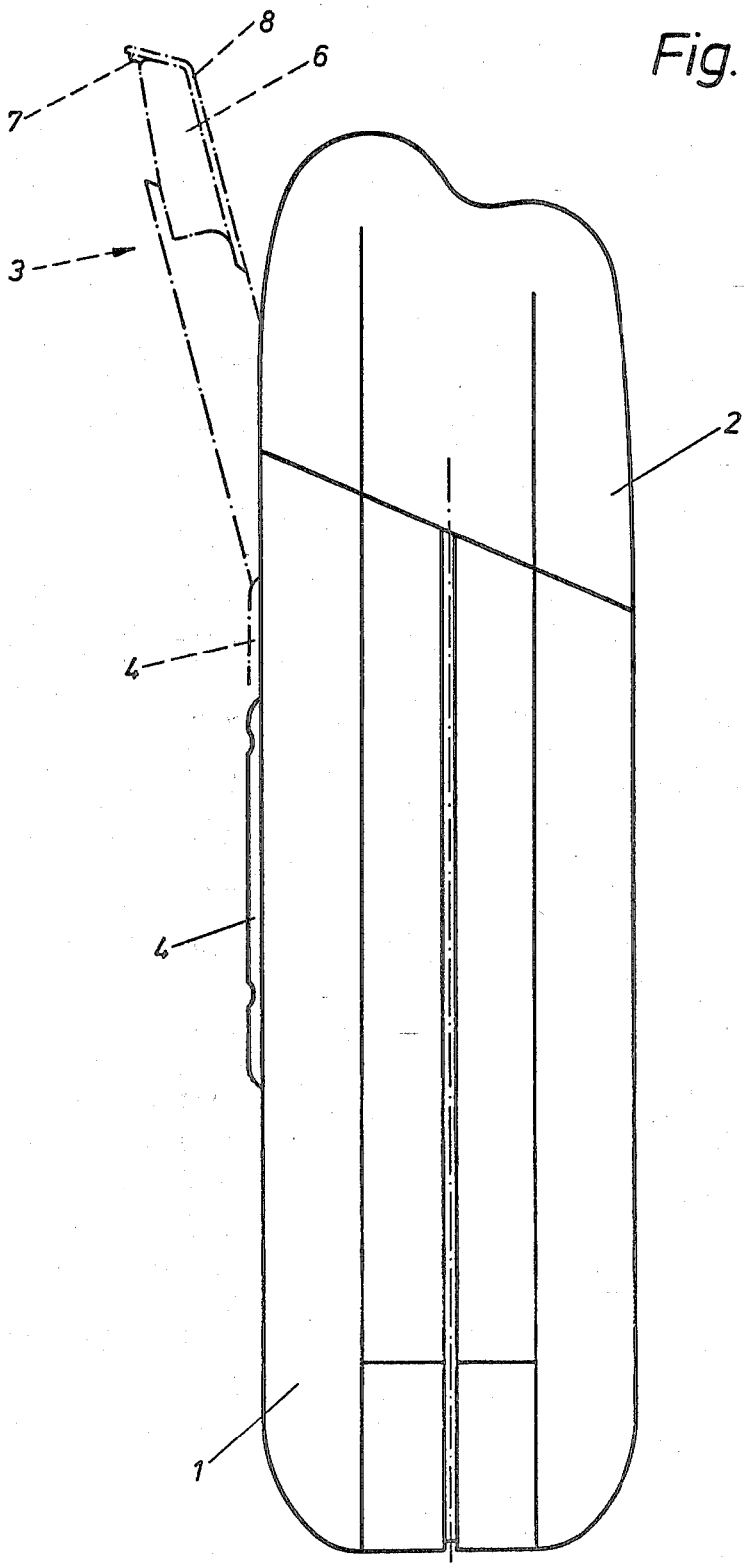
FIG. 2 is a side elevational view of the narrow side of the shaver indicating the long-hair cutting unit in its extended position in broken lines.
Figure 3:
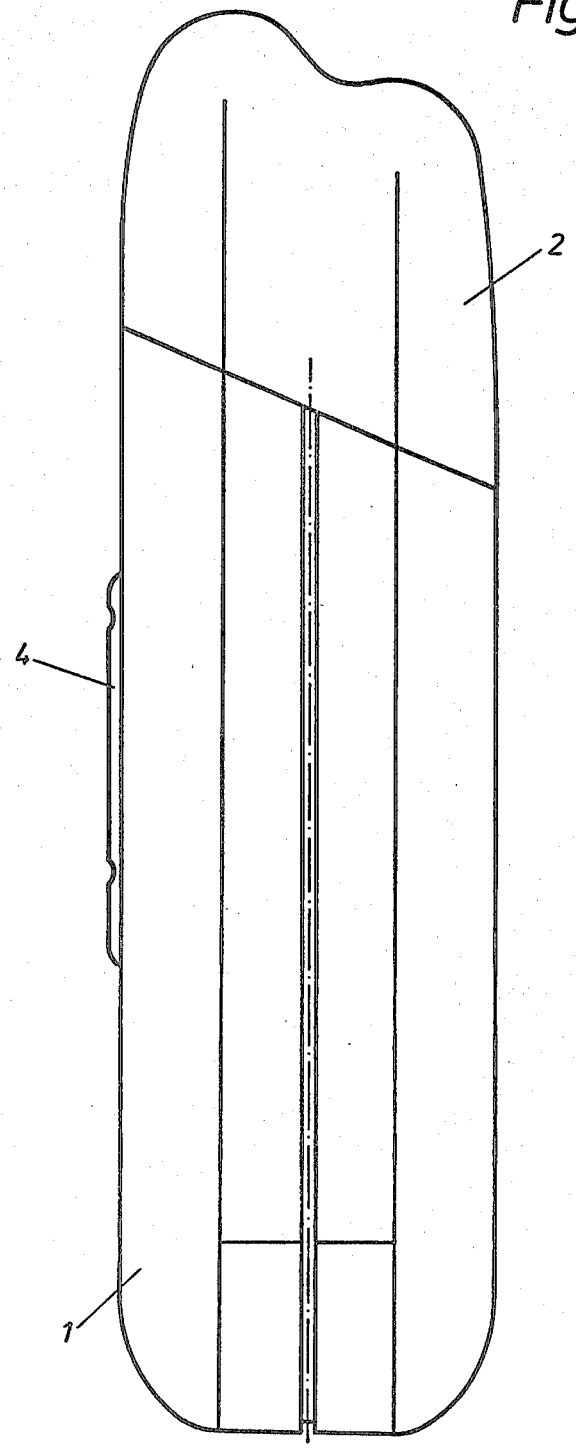
FIG. 3 is a side elevational view of the same narrow side of the shaver with the long-hair cutting unit its retracted position.

According to FIGS. 1 to 3, the shaver according to the invention consists of the casing 1 containing the driving unit and the electrical means; the casing 1 carries a double shear head 2 in stepped arrangement and a long-hair cutting unit 3 manually extendable or retractable by means of the actuating pusher 4 arranged on the broad side of the shaver. As shown in FIG. 2, the cutting unit 3 in its extended state protrudes with its knife support 6, mobile knife 7 and clipping comb 8 sufficiently far beyond the shear head to assure vision, unimpaired by the shear head, of the spot to be cut and easy access to the spots difficult to get to with the long-hair cutter. On the other hand, it is evident from FIG. 1 and in particular from FIG. 3 that the long-hair cutter in its retracted state is received within the casing 1 of the shaver and completely disappears therein.

Figure 6:
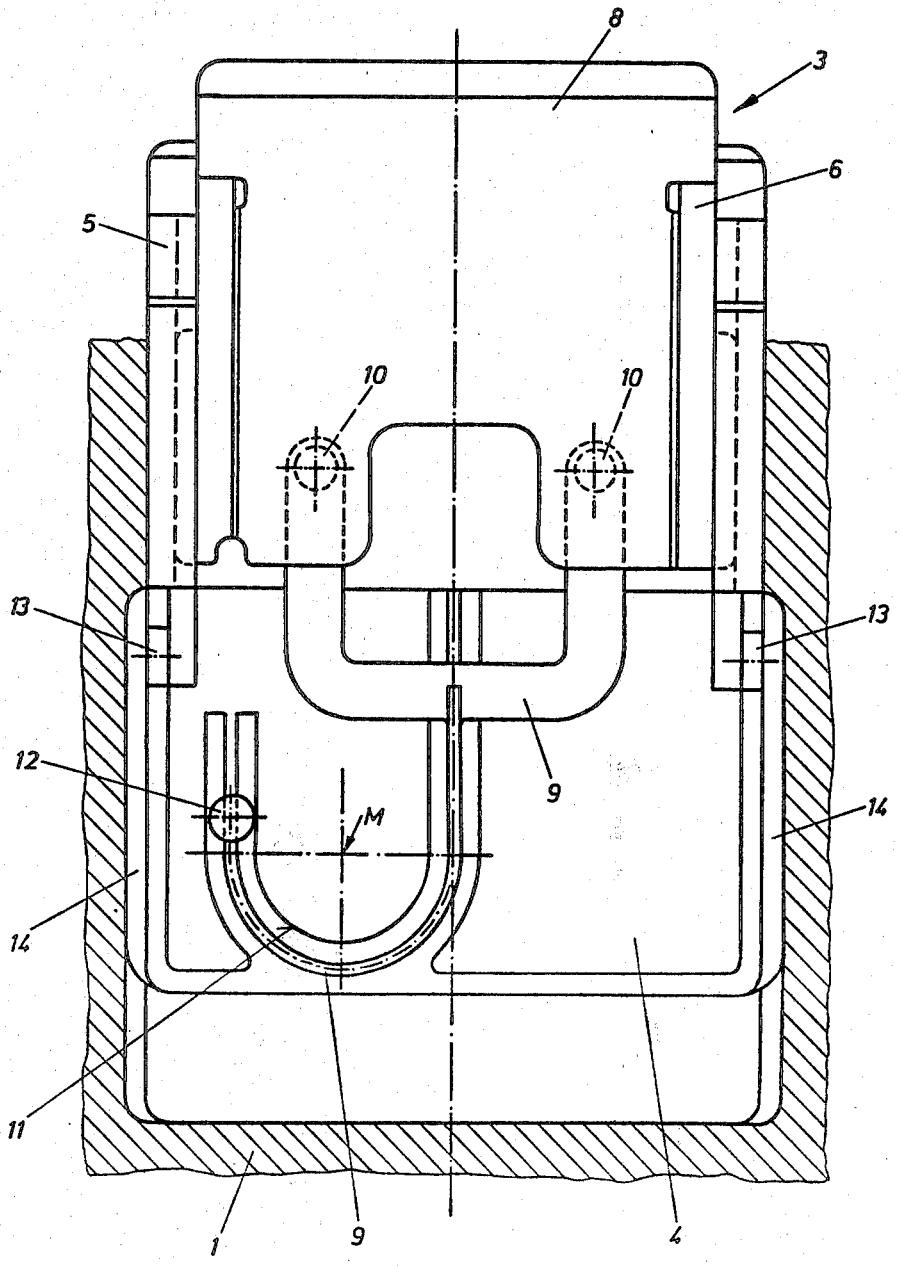
FIG. 6 shows a section through the long-hair cutting unit according to FIG. 1 in its extended state.
Figure 7:
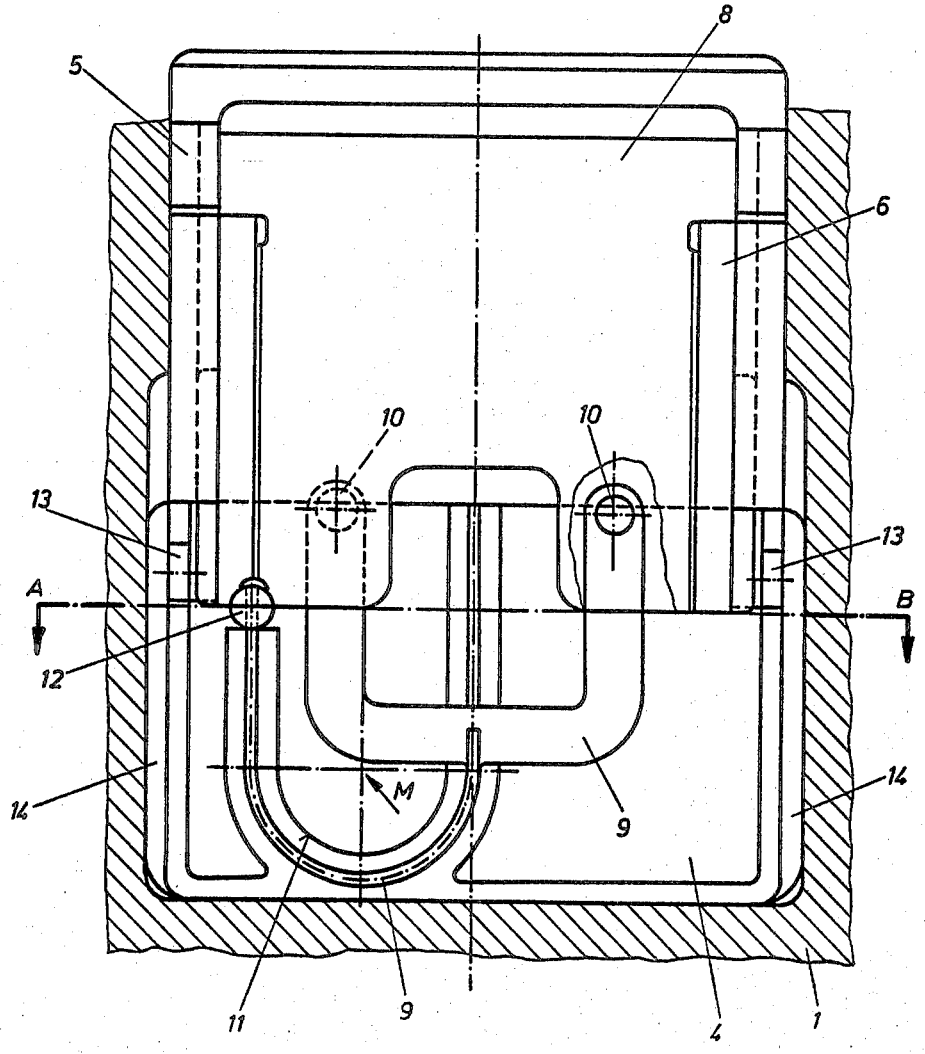
FIG. 7 shows the corresponding section in the retracted state.
Figure 8:
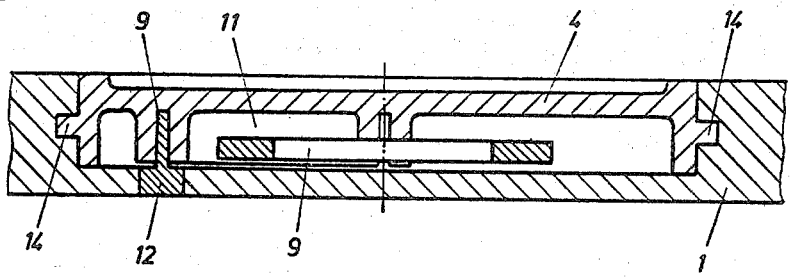
FIG. 8 shows a section along line AB in FIG. 7.

FIGS. 6 to 8 show the telescopic extending and retracting operation of the long-hair cutting unit 3. One end 12 of the push-pull strip 9 is firmly anchored within the casing 1 and thus constitutes the fixed point of the push-pull strip 9 on the casing 1. The second end 10 of the push-pull strip 9 is connected to the knife support 6 of the long-hair cutting unit 3; point 10 is displaceable in relation to the casing 1. Between the two points or ends 10 and 12, the push-pull strip 9 is turned by 180° by means of a semicircular guide 11 provided in the actuating pusher 4. The center of the semicircular guide 11 bears the reference symbol M.

The pusher 4 and with it the semicircular guide 11 is supported within the casing 1 rectilinearly displaceable by a limited distance s (FIG. 9) by means of the sliding guide 14.

Figure 5:
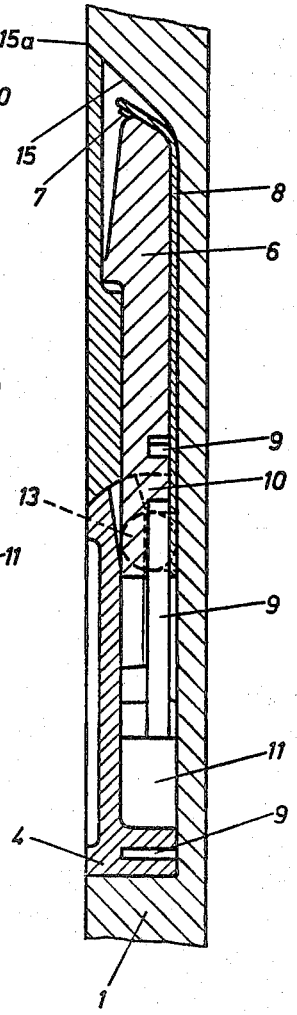
FIG. 5 shows a corresponding longitudinal cross section in the retracted state according to FIG. 3.

When the user of the shaver moves the actuating pusher 4 upwards, starting out from the retracted position of the long-hair cutting unit 2 shown in FIGS. 5 and 7, in the direction of the fixed point 12 on the casing of the push-pull strip 9, the other end 10 of the push-pull strip 9, with the knife support 6 attached to it, will move by one distance s (FIG. 9) of the pusher 4 in the same direction and in addition by one distance s (FIG. 9) equal to the change in length of the push-pull strip between the fixed end 12 within the casing 1 and the beginning of the semicircular guide 11. Since both distances are equal, the knife support 6 moves twice the distance s (FIG. 9) of the pusher 4, so that the knife support 6 with the mobile knife 7 and clipping comb 8, i.e., the entire long-hair cutting unit 3, can be telescopically extended from and retracted into the casing 1. The push-pull strip 9 connecting the pusher 4 to the knife support 6 can thus be considered as a coupling between the two elements with the effect of a gear (transmission).

FIG. 9 again shows the doubling of the distance by means of a diagrammatic view of the push-pull strip 9. Full lines and plain reference symbols show the retracted state, while broken (dashed) lines and reference symbols with apostrophes show the extended state.

Figure 10:
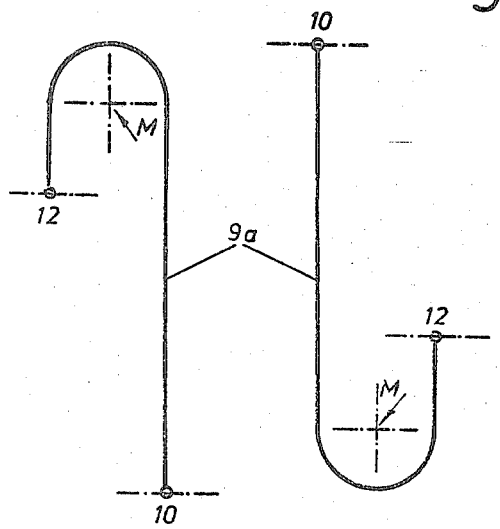
FIG. 10 shows an analogous diagrammatic view with two tension strips or tension cables.

FIG. 10 shows a diagrammatic view of an example for the simple replacement of the push-pull strip 9 by two tension strips or tension cables 9a. It would of course also be possible to provide a gear wheel—gear rack transmission, a lever transmission or an eccentric transmission.

It is understood that by an appropriate selection of the transmission ratio, the knife support 6, if necessary, could cover more than double the distance s (FIG. 9) traveled by the pusher 4.

Figure 9:
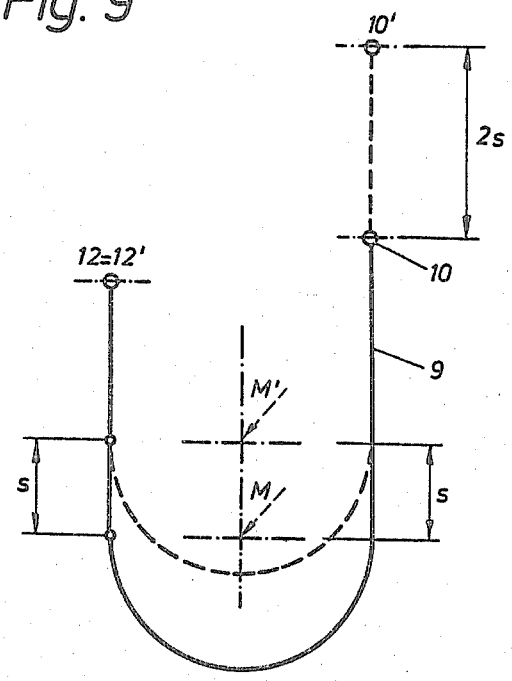
FIG. 9 shows a diagrammatic view of the doubling of the distance in a push-pull strip.
Figures 11A, 11B:
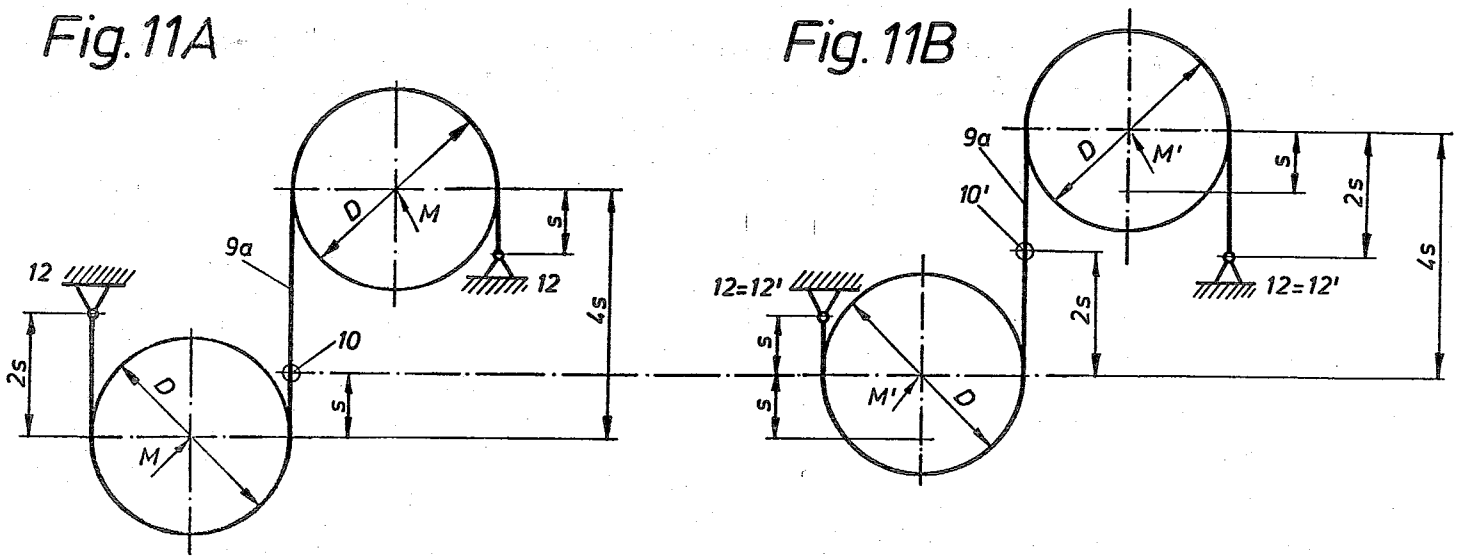
FIGS. 11A and 11B show an analogous diagrammatic view with one single tension strip or tension cable.

FIGS. 11A and 11B are diagrammatic views analogous to FIGS. 9 and 10 and show a further possibility of doubling the distance 2s of the knife support 6 in relation to the distance s of the pusher 4 by means of a single tension strip or tension cable 9a. FIG. 11A shows the retracted position (plain reference symbols) and FIG. 11B the extended position (reference symobls with apostrophes) of the knife support 12 and 12' are again the fixed points on the casing and 10 and 10' mark the point of the tension strip or tension cable 9a fixed on the knife support 6. M and m' again indicate the center of the semicircular guide for the tension strip or tension cable. If only one tension strip or tension cable 9a is used, two semicircular guides connected to the actuating pusher 4 are required and the tension strip or tension cable 9a is permanently fixed to the casing 1 at both of its ends (point 12 and 12'). The connection point 10 with the knife support 6 and the long-hair cutting unit 3 is positioned between these two ends. The entire length of the tension strip or tension cable 9a is equal to $7s+D\cdot\pi$ and the distance of the left-hand point 12 shown in FIG. 11A from point 10 equals $3s+D/2\cdot\pi$.

As particularly clear from FIGS. 11A and 11B, it will be understood that in all embodiments the semicircular guides 11 could have the form of guides (for example, rollers) rotatable in relation to the actuating pusher 4.

The mobile knife 7 positioned in the knife support 6 is driven in a manner known per se.

Figure 4:
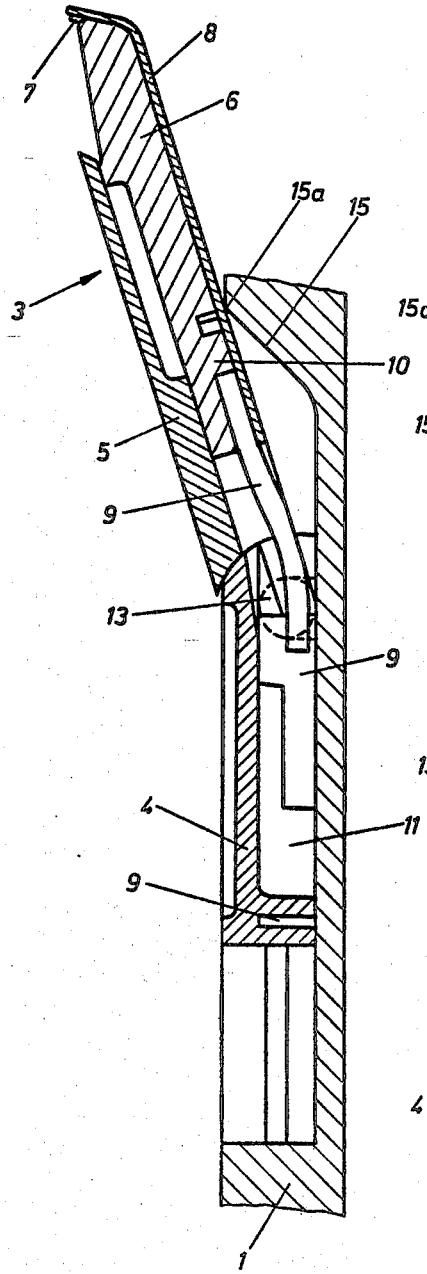
FIG. 4 is a fragmentary longitudinal cross-section of the extended long-hair cutting unit including the actuating pusher in its extended position according to FIG. 2.

A particularly advantageous movement of the long-hair cutting unit 3 is achieved if this unit, as will be particularly clear from FIG. 4, is composed of the tilting member 5 pivotably supported on the pusher 4 by means of articulations 13, the knife support 6 with mobile knife 7 and clipping comb 8 being pivotable together with the tilting member 5 by a limited angle. The knife support 6 with mobile knife 7 and clipping comb 8 are slidably supported in relation to the tilting member 5. When the pusher 4 is moved upwards in the course of the extending operation of the long-hair cutting unit 3, the clipping comb 8 abuts the inclined surface 15 of the casing 1 and this causes pivoting movement of the long-hair cutting unit 3 upon further displacement of the pusher 4. The long-hair cutting unit 3 is held in its pivoted position by the terminal edge 15a of the inclinded surface 15 of the casing acting upon the clipping comb 8.

The inclined surface 15 with terminal edge 15a which serves to guide the long-hair cutting unit 3 in an inclined path, could, of course, be replaced by equivalent guide elements, for example, by pins provided on either side of the tilting element 5 and engaging curved or bent guide slots provided in the casing 1.

FIG. 5 clearly shows how the long-hair cutting unit 3 in its retracted state is completely contained in a depression in casing 1 and totally covered by the tilting member 5, so that the casing can be provided with a smooth exterior surface throughout.

I claim:

1. An electric shaver having a casing, a shear head and a long-hair cutting unit, characterized in that the long-hair cutting unit is slidably supported by the casing for movement from a retracted position in which the long-hair cutting unit lies within the confines of the casing to an extended position in which the cutting unit projects outwardly from the casing, a manually actuatable pusher for moving said long-hair cutting unit from one position to the other, guide means sidably mounting said pusher for movement relative to said casing, and motion multiplying coupling means comprising at least one flexible strip interconnecting said long-hair cutting unit and said pusher, and a semicircular guide in said pusher position to engage said strip and reverse its direction, whereby said long-hair cutting unit moves at least twice the distance through which the pusher travels when actuated.

2. A shaver in accordance with claim 1 wherein said motion multiplying coupling means comprises a flexible push-pull strip permanently fixed at one end to said casing and connected at its opposite end to said long-hair cutting unit, said push-pull strip being slidably supported intermediate its opposite ends by said semicircular guide, said guide acting to turn said strip through an angle of 180°.

3. A shaver according to claim 1 wherein said motion multiplying coupling means comprises a pair of tension strips each of which is permanently fixed at one end to said casing and connected at its opposite end to said long-hair cutting unit, and a pair of oppositely directed semicircular guides in said pusher, each of said guides supporting one of said pair of tension strips and acting to turn each strip through an angle of 180°.

4. A shaver according to claim 1 wherein said motion multiplying coupling means comprises a flexible tension strip having its opposite ends permanently fixed to said casing, and a pair of oppositely directed semicircular guides in said pusher positioned to turn portions of the strip adjacent each end thereof through angles of 180°, the turns so formed extending in opposite directions, the strip being connected to said long-hair cutting unit intermediate said oppositely directed turns.

5. A shaver according to any one of claims 1–4 wherein said long-hair cutting unit comprises a tilting member pivotally connected to said pusher, a knife support, a mobile knife, and a clipping comb, said knife support, said mobile knife, and said clipping comb being slidably mounted on said tilting member for pivotal movement therewith, said motion multiplying coupling means being connected to said knife support, and guide means in said casing for pivoting said tilting member as said pusher is moved, whereby said long-hair cutting unit is caused to pivot relative to said casing as it is extended and retracted.

6. A shaver according to claim 5 wherein said guide means comprises an inclined surface in said casing positioned to be contacted by said clipping comb as said long-hair cutting unit is extended and retracted.

7. A shaver according to claim 1 wherein said entire long-hair cutting unit and said pusher are arranged within a depression in said casing, whereby said long-hair cutting unit is flush with the casing in its retracted condition.

* * * * *